US011622431B2

(12) United States Patent
Maya

(10) Patent No.: US 11,622,431 B2
(45) Date of Patent: Apr. 4, 2023

(54) METHOD AND APPARATUS TO CONTROL BI-COLOR LEDS ON ENTERPRISE AND DATACENTER SOLID STATE DRIVE (E3) FORM FACTOR

(71) Applicant: Western Digital Technologies, Inc., San Jose, CA (US)

(72) Inventor: Tenzin Namgyal Maya, Bangalore (IN)

(73) Assignee: Western Digital Technologies, Inc., San Jose, CA (US)

( * ) Notice: Subject to any disclaimer, the term of this patent is extended or adjusted under 35 U.S.C. 154(b) by 0 days.

(21) Appl. No.: 17/363,000

(22) Filed: Jun. 30, 2021

(65) Prior Publication Data

US 2023/0007748 A1 Jan. 5, 2023

(51) Int. Cl.
*H05B 45/44* (2020.01)

(52) U.S. Cl.
CPC ..... *H05B 45/44* (2020.01)

(58) Field of Classification Search
CPC ..... H05B 45/20; H05B 45/48; H05B 45/395; H05B 45/40; H05B 45/44; H05B 45/46
See application file for complete search history.

(56) References Cited

U.S. PATENT DOCUMENTS 4,420,711 A * 12/1983 Takahashi ..... H04S 7/40 315/296
4,837,565 A * 6/1989 White ..... G09F 9/33 340/815.45
5,757,275 A * 5/1998 Mowry, Jr. ..... G05B 19/054 340/657
6,906,502 B2 * 6/2005 Kernahan ..... H02M 1/0845 361/91.7
10,182,486 B2 * 1/2019 Akiyama ..... H05B 45/395
2005/0248897 A1 * 11/2005 Sadjadi ..... G08B 5/36 361/115
2006/0232435 A1 * 10/2006 Sotiriou ..... G08B 5/36 340/815.4
2011/0109244 A1 * 5/2011 Grajcar ..... H05B 45/48 315/294
2014/0210352 A1 * 7/2014 Grajcar ..... H05B 45/3725 315/122
2014/0361711 A1 * 12/2014 Takahashi ..... H05B 45/395 315/294
2015/0373809 A1 * 12/2015 Oraw ..... H05B 45/48 315/210
2018/0376555 A1 * 12/2018 Wang ..... H05B 45/395

OTHER PUBLICATIONS

SNIA, "Enterprise and Datacenter Standard Form Factor Pin and Signal Specification" Revision 2.0.5, SNIA SFF TWG Technology Affiliate, published Mar. 5, 2021 (Year: 2021).*

(Continued)

*Primary Examiner* — Kurtis R Bahr
(74) *Attorney, Agent, or Firm* — Chang & Hale LLP

(57) ABSTRACT

Systems and methods are disclosed for controlling the operation of visual indicators, such as light emitting diodes (LEDs). A novel circuit may be employed to energize one indicator while de-energizing a second indicator, and vice versa. The novel circuit uses at least one switching component to perform a switching operation on the indicators.

19 Claims, 5 Drawing Sheets

(56) References Cited

OTHER PUBLICATIONS

SNIA, "Enterprise and Datacenter Standard Form Factor Pin and Signal Specification" Revision 3.0a, SNIA SFF TWG Technology Affiliate, published Oct. 8, 2021 (Year: 2021).*
SNIA, "SFF Specifications", https://www.snia.org/technology-communities/sff/specifications; page visited: Dec. 17, 2021 (Year: 2021).*
Kaier, "EDSF: The future of enterprise storage and beyond", Aug. 2018, Flash Memory Summit; p. 3 (Year: 2018).*
SNIA, "SFF-TA-1008 Enterprise and Datacenter Device Form Factor (E3)"; published Nov. 6, 2020 (Year: 2020).*

* cited by examiner

| LED (pin A10) signal state | (Yellow) LED2 state | (Blue) LED1 state |
|---|---|---|
| Asserted (driven high) | "On" | "Off" |
| De-asserted (driven low) | "Off" | "On" |
| High impedance (not driven) | "Off" | "Off" |

FIG. 1

METHOD AND APPARATUS TO CONTROL BI-COLOR LEDS ON ENTERPRISE AND DATACENTER SOLID STATE DRIVE (E3) FORM FACTOR

BACKGROUND

The new industry-wide standards specification for Enterprise and Datacenter Solid State Drive (E3) Form Factor calls out a new requirement of a bi-color light emitting diode (LED) status indicator. The specification includes some requirements for turning the LEDs on and off, which necessitates a new circuitry to control these functions.

BRIEF DESCRIPTION OF THE DRAWINGS

Various embodiments are depicted in the accompanying drawings for illustrative purposes and should in no way be interpreted as limiting the scope of this disclosure. In addition, various features of different disclosed embodiments can be combined to form additional embodiments, which are part of this disclosure.

FIG. 1 shows a table of desired indicator operational states.

DETAILED DESCRIPTION

While certain embodiments are described, these embodiments are presented by way of example only, and are not intended to limit the scope of protection. Indeed, the novel methods and systems described herein may be embodied in a variety of other forms. Furthermore, various omissions, substitutions, and changes in the form of the methods and systems described herein may be made without departing from the scope of protection.

The headings provided herein are for convenience only and do not necessarily affect the scope or meaning of the claims. Disclosed herein are example configurations and embodiments relating to control circuits for visual (e.g., illuminated) indicators used with data storage devices.

Overview

A new industry-wide standard for solid-state storage devices (e.g., solid state drives (SSDs)), titled "Enterprise and Datacenter Standard Form Factor Pin and Signal Specification," SFF-TA-1009, Rev. 3.0, Mar. 19, 2021, includes a new requirement of having an illuminated bi-color status indicator as part of the form factor of the devices. A novel circuit is disclosed herein for controlling the operation of the bi-color indicator specified, which may be implemented as a pair of light emitting diodes (LEDs). The new circuit provides that each color of the indicator (or illuminating element of the indicator, e.g., LED) is illuminated according to a control signal at a pin (e.g., LED_PinA10) of the drive connector. A source voltage of 12V is also supplied to the circuit at another pin of the drive connector. The specification further requires a current limiting resistor as part of the circuit to limit overcurrent. In an embodiment, the circuit is limited to not more than 20 mA current draw at the LED drive control pin of the drive connector.

The required indicator states are shown in the table at FIG. 1 and are based on the voltage presented at the drive control signal pin. When the drive control pin is asserted, meaning driven at a higher voltage (e.g., 3.3 volts), the first indicator is illuminated, and the second indicator is not. When the drive control pin is de-asserted, meaning driven at a lower voltage (e.g., 1.0 volts), the second indicator is illuminated, and the first indicator is not. In a high impedance state, when the drive control pin is not driven, neither indicator is illuminated.

Embodiments of a novel circuit are disclosed that meet the new requirements of the Form Factor Specification, including the states of the illuminated status indicator(s), make use of a minimum number of discrete components, are robust, and can be implemented at a low cost. Additionally, in some described embodiments, a first lead of the indicator control circuit is coupled to a common anode of the first and second status indicators. The embodiments are described with reference to FIGS. 2-5.

Example Embodiments

Figure 2:
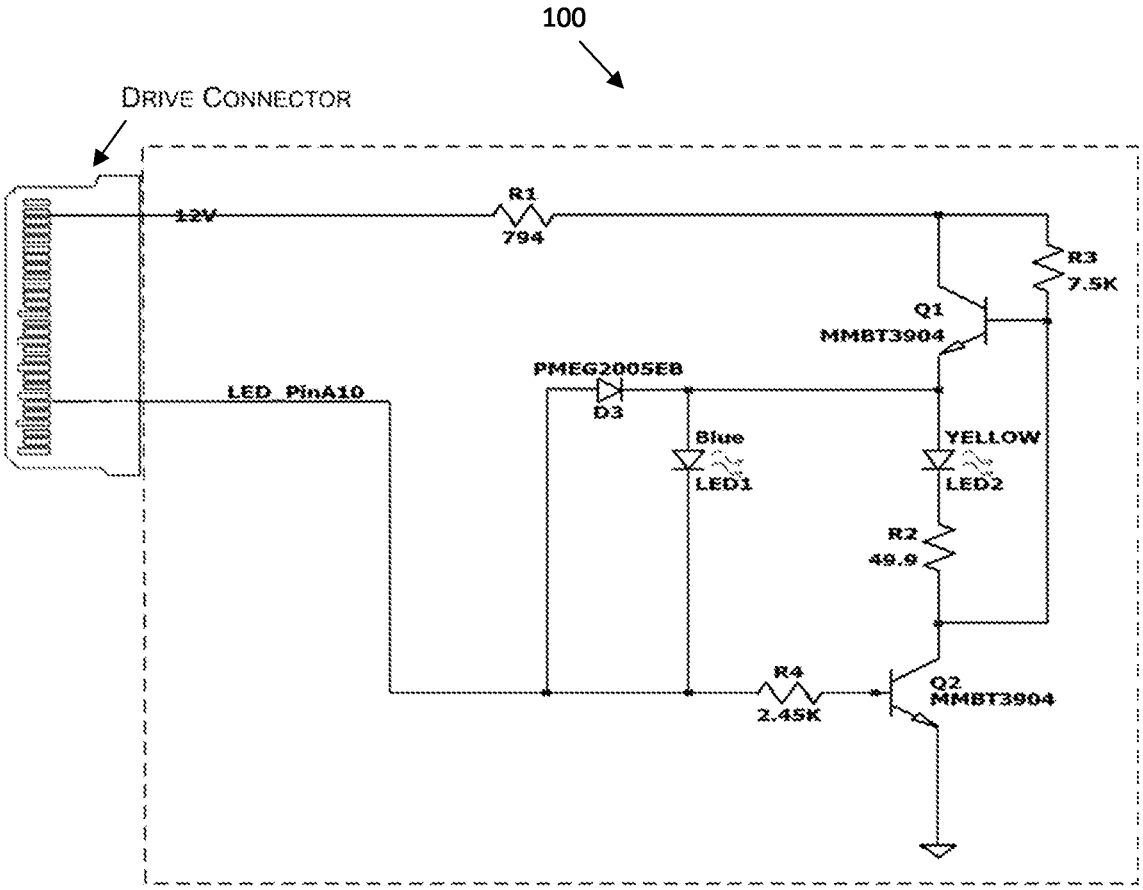
FIG. 2 shows a schematic diagram of an example indicator control circuit, according to one or more embodiments.

FIG. 2 is a schematic diagram of a novel control circuit 100 for controlling the illumination states of a pair of visual indicators, according to a first embodiment. While LEDs are shown and discussed herein, it is not intended to be limiting and any other indicators are also within the scope of the disclosure. In an implementation, the circuit 100 fulfills the requirements of controlling the LEDs in accordance with the form factor specification using a minimum quantity of discrete components. For example, in the embodiment shown at FIG. 2, the discrete components consist of one dual LED package with common anode, one dual NPN bipolar junction transistor (BJT), four resistors, and one diode.

In the embodiment, the host driver of the storage device controls the voltage at the drive control pin (e.g., LED_PinA10), thereby controlling the state of LED1 and LED2 (as shown at FIG. 1). As the voltage at the drive control pin changes, the illumination state of the LEDs changes accordingly.

For example, referring to FIG. 2, when the drive control pin (LED_PinA10) is asserted, meaning driven high by the host driver, the voltage at the drive control pin may be between 1.5 and 3.5 volts in some cases. In alternate embodiments, the "high" state may include voltages at the drive control pin of less than 1.5 volts and/or more than 3.5 volts.

In the asserted state, transistor Q2 is turned on via resistor R4, turning off transistor Q1. The second LED (LED2) is energized through the blocking diode D3, illuminating LED2. The resistor R2 limits the current through LED2. As shown in FIG. 2, the resistor R2 may have a resistance value of approximately 50 ohms. The anode voltage of the first LED (LED1) is less than the voltage at the cathode, so LED1 is de-energized (not illuminated).

When the drive control pin (LED_PinA10) is de-asserted, meaning driven low by the host driver, the voltage at the drive control pin may be between 0.7 and 1.5 volts in some cases. In alternate embodiments, the "low" state may include voltages less than 0.7 volts and/or more than 1.5 volts.

In the de-asserted state, transistor Q2 is turned off via resistor R4, turning on transistor Q1. Consequently, the second LED (LED2) is de-energized (not illuminated). As shown in FIG. 2, the resistor R4 may have a resistance value of approximately 2.45 kilo-ohms. The host driver sinks the current through LED1, driving the net low, so LED1 is energized (illuminated). Resistor R1 limits the current through LED1. As shown in FIG. 2, the resistor R1 may have a resistance value of approximately 800 ohms.

When the drive control pin is in a high impedance state (e.g., not driven by the host driver), this turns off transistor Q2 and turns on transistor Q1. The leakage current can be about −2.11 uA, which generates a 5 mV drop across resistor R4. This can raise the net voltage at the drive control pin (LED_PinA10) to about −705 mV (e.g., R4's 5 mV drop+ Q2's 700 mV base-emitter drop). Under these conditions, neither the first (LED1) or the second (LED2) LED is energized or illuminated. For example, the current through LED1 can be under 2.11 uA and the current through LED2 is approximately −0 A.

In an embodiment, the function of the second LED (LED2) is independent of the 12V source voltage feeding the circuit 100. For instance, if the 12V source is turned off, the second LED (LED2) functions as indicated in the table at FIG. 1. However, the first LED (LED1) may be de-energized so long as the source voltage is off.

Figure 3:
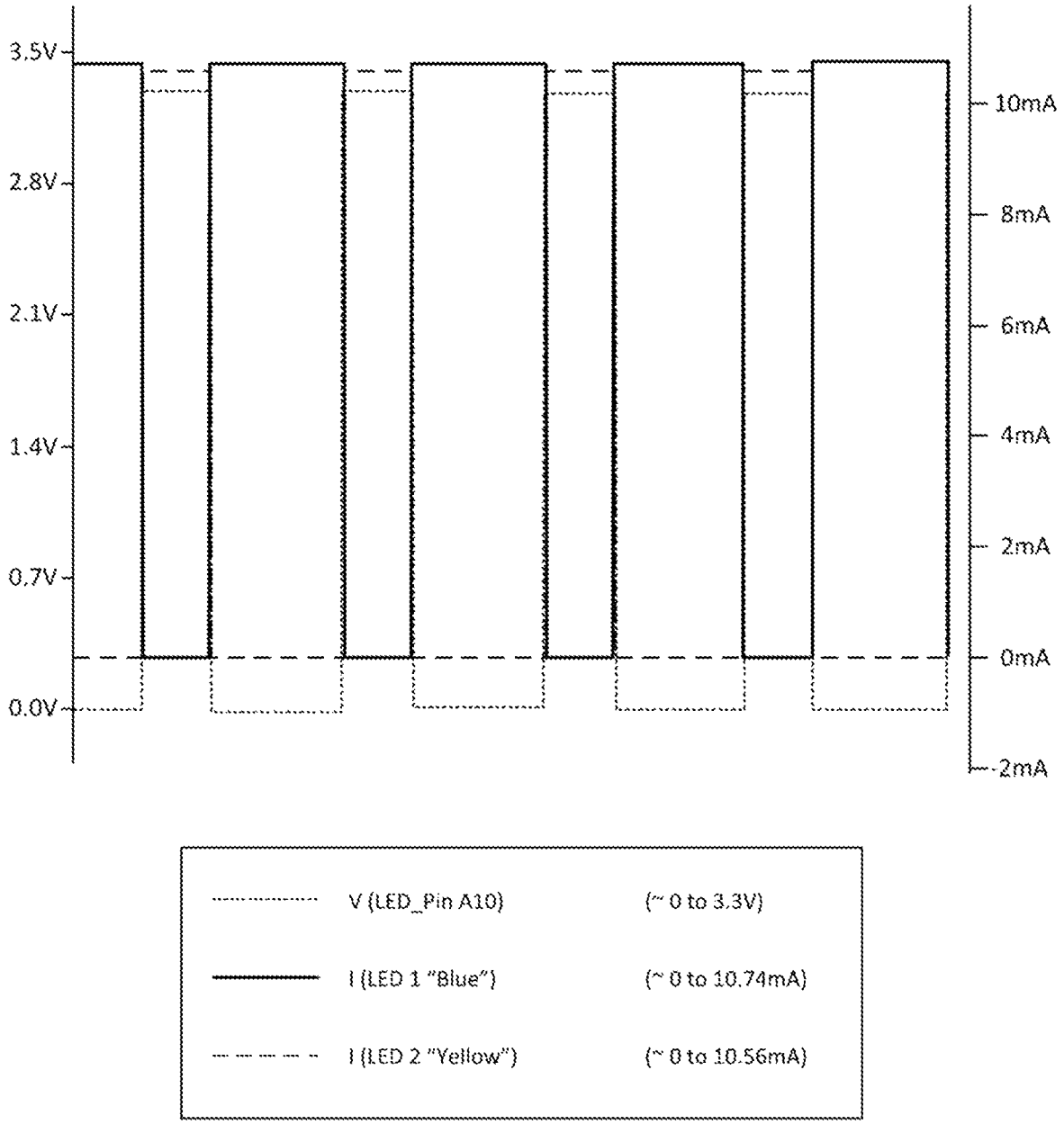
FIG. 3 shows a state diagram of the operation of a pair of indicators, based on a control signal, according to one or more embodiments.

The graph at FIG. 3 shows a state diagram of the first and second indicators (LED1 and LED2) with the drive control pin (LED_PinA10) asserted and de-asserted. The voltage at the drive control pin (LED_PinA10) is shown with the dotted line. By way of example, the voltage at the pin is shown alternating between 0V and 3.3V for a period of 100 ms. The current through the first indicator (LED1) is shown with a solid line and the current through the second indicator (LED2) is shown with a dashed line. The approximate current through each indicator when it is illuminated is about 10.6 mA. The selection of the resistors in the circuit controls the current through the indicators, which maintains the specified low current draw. Note that as shown in FIG. 2, the resistor R3 may have a resistance value of approximately 7.5 kilo-ohms.

Referring to FIG. 3, as shown in the state diagram, when the drive control pin is asserted, meaning driven at a relatively higher voltage (e.g., about 3.3 volts), the first indicator is illuminated, and the second indicator is not. When the drive control pin is de-asserted, meaning driven at a relatively lower voltage (e.g., between 0 and 0.7 volts), the second indicator is illuminated, and the first indicator is not. Only one of the first (LED1) and second (LED2) indicators is illuminated at a time, or neither is illuminated.

In the embodiments shown herein, the first LED (LED1) is shown as having the color blue and the second LED (LED2) is shown as having the color yellow. This is not intended to be limiting either, as the circuit may be used to control indicators (e.g., LEDs) having any colors. In an alternate embodiment, the colors of the LEDs may be the same, and the first and second indication may be given by some other characteristics of the LEDs (such as position or location, an illuminated symbol or digit, or the like).

Additional Embodiments

Those skilled in the art will appreciate that in some embodiments, other types of indicator control methods and systems can be implemented while remaining within the scope of the present disclosure. In addition, components may be used to implement the functions described herein that may differ from those described or shown in the figures. Depending on the embodiment, certain of the components described above may be removed or replaced, and/or others may be added.

Figure 4:
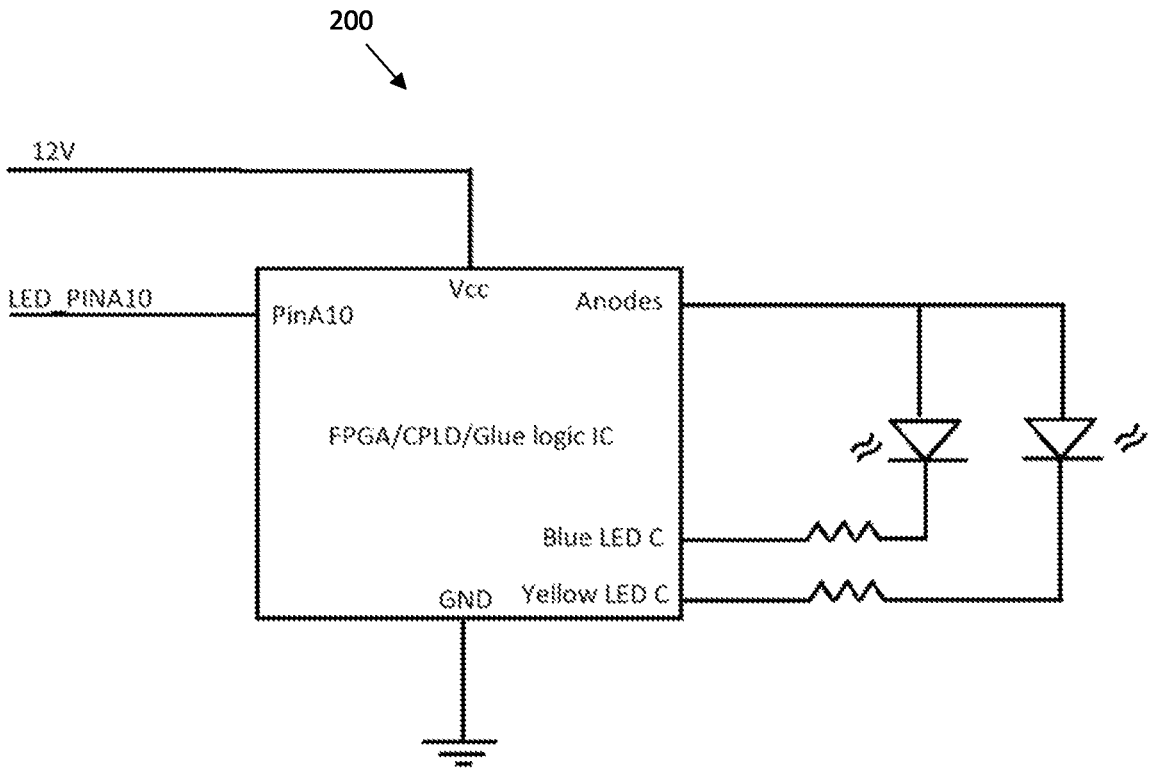
FIG. 4 shows a schematic diagram of an example indicator control circuit, according to one or more alternate embodiments.

FIG. 4 shows a schematic of an alternate circuit 200 that may also be used to implement the specified LED drive control. In various embodiments, the control of the LEDs may be programmed into a logic component IC, such as a Field Programmable Gate Array (FPGA), a Complex Programmable Logic Device (CPLD), Glue Logic IC, or any other like devices. In the embodiments, the control logic is programmed into the device relative to the pins used to couple the remaining discrete components, such as the first and second LEDs and resistors.

As shown at FIG. 4, the drive control pin (LED_PinA10) is one input to the logic circuit/device, as well as a 12V source voltage. The common anodes of the first (LED1) and second (LED2) indicators are coupled to a third pin of the logic device. The cathode of each indicator is coupled to a separate pin of the logic circuit/device via a resistor to control current through the indicators. As shown at FIG. 4, a ground connection is included.

The cost of the implementations shown at FIG. 4 likely exceeds the cost of the implementations shown at FIG. 2. The logic components and devices are more expensive to provide and the implementation, including programming, adds to the cost.

Figure 5:
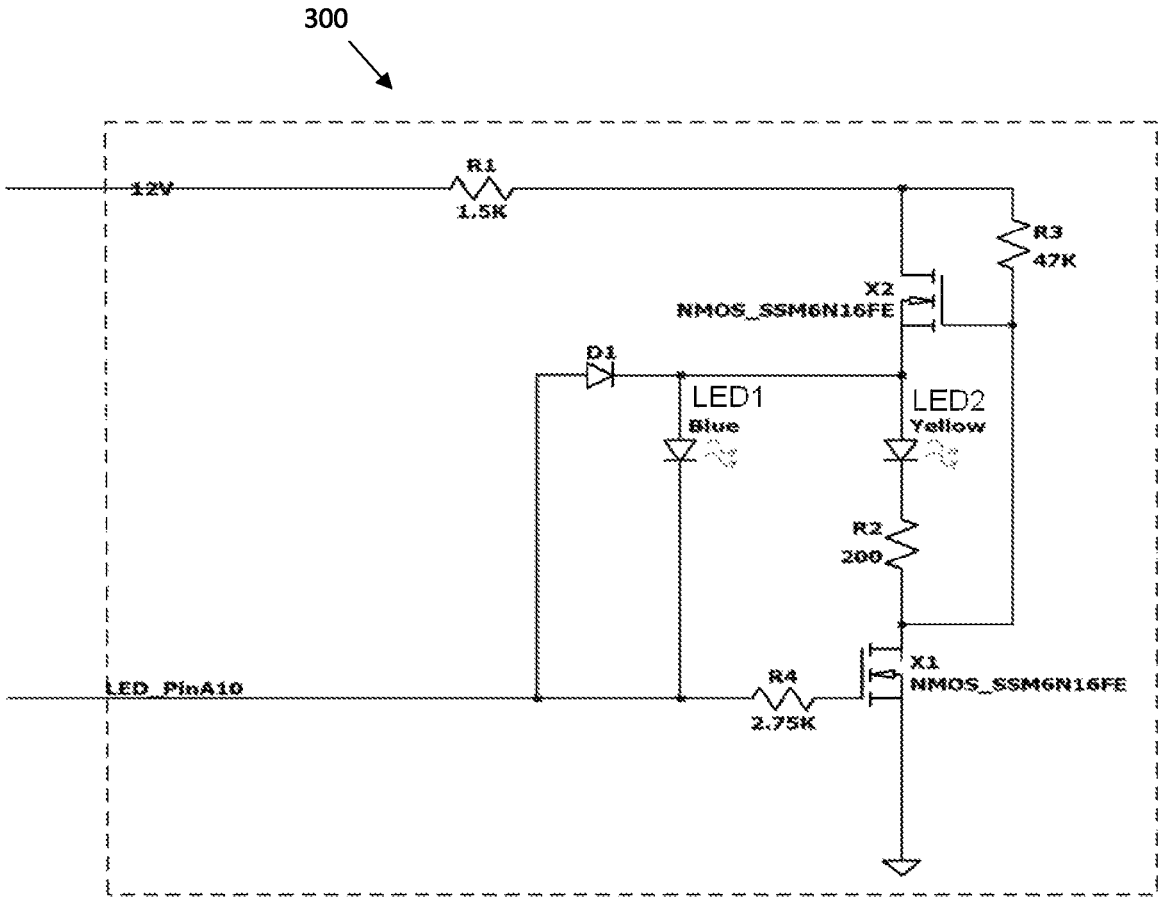
FIG. 5 shows a schematic diagram of another example indicator control circuit, according to one or more embodiments.

FIG. 5 illustrates an alternate circuit 300 that uses metal oxide semiconductor field-effect transistors (MOSFETs), or the like, rather than bipolar junction transistors (BJTs) as used in the implementation of FIG. 2. The circuit layout and operation are similar to the circuit 100 illustrated in FIG. 2, but the use of MOSFET devices may also increase the overall cost of the circuit.

While certain embodiments have been described, these embodiments have been presented by way of example only and are not intended to limit the scope of protection. Indeed, the novel methods and systems described herein may be embodied in a variety of other forms. Furthermore, various omissions, substitutions, and changes in the form of the methods and systems described herein may be made. The accompanying claims and their equivalents are intended to cover such forms or modifications as would fall within the scope and spirit of the protection. For example, in some cases, the various components illustrated in the figures may be implemented as software and/or firmware on a processor, application-specific integrated circuit (ASIC), field-programmable gate array (FPGA), or dedicated hardware. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. An electrical circuit comprising:

a first light emitting diode (LED) having a first color responsive to being energized;

a second LED having a second, different color responsive to being energized, the second LED and the first LED having a common anode;

a first switching device, an output of the first switching device coupled to the common anode of the first and second LEDs; and a second switching device, a control input of the second switching device coupled to a cathode of the first LED through a first predetermined impedance and an input of the second switching device coupled to a cathode of the second LED through a second predetermined impedance, such that when the first LED is energized the second LED is de-energized and when the second LED is energized the first LED is de-energized.

2. The electrical circuit of claim 1, further comprising a source voltage lead coupled to an input of the first switching device via a third predetermined impedance.

3. The electrical circuit of claim 1, further comprising an LED control lead configured to transmit a switching control signal arranged to energize the first LED or the second LED, based on a value of the signal, the LED control lead coupled to the control input of the second switching device via the first predetermined impedance.

4. The electrical circuit of claim 3, wherein the LED control lead is coupled to the cathode of the first LED.

5. The electrical circuit of claim 3, wherein the second LED is energized and the first LED is de-energized responsive to the switching control signal having a voltage value of at least a first predetermined voltage, and wherein the first LED is energized and the second LED is de-energized responsive to the switching control signal having a voltage value of less than a second predetermined voltage, the second predetermined voltage being less than the first predetermined voltage.

6. The electrical circuit of claim 1, further comprising a blocking diode coupled in parallel with the first LED, the blocking diode having a polarity opposite to the first LED.

7. The electrical circuit of claim 1, wherein the first LED and the second LED have a common package.

8. The electrical circuit of claim 1, wherein the first predetermined impedance and the second predetermined impedance comprise first and second resistors, respectively.

9. The electrical circuit of claim 1, wherein the first and second impedances are selected such that a maximum circuit current is less than 20 mA.

10. An electrical circuit comprising:

a first visual indicator having a first color responsive to being energized;

a second visual indicator having a second, different color responsive to being energized, the second indicator and the first indicator having a common anode;

a first transistor, an output of the first transistor coupled to the common anode of the first and second indicators;

a second transistor, a base or gate of the second transistor coupled to a cathode of the first indicator via a first predetermined impedance and an input of the second transistor coupled to a cathode of the second indicator via a second predetermined impedance; and an indicator control lead configured to carry a switching control signal to the base or gate of the second transistor via the first predetermined impedance, the switching control signal arranged to trigger the first or second indicator to energize, based on a value of the signal.

11. The electrical circuit of claim 10, further comprising a source voltage lead coupled to an input of the first transistor via a third predetermined impedance.

12. The electrical circuit of claim 11, wherein the second indicator is configured to illuminate independent of the presence of a voltage at the source voltage lead.

13. The electrical circuit of claim 11, wherein when the first indicator is energized the second indicator is de-energized and when the second indicator is energized the first indicator is de-energized.

14. The electrical circuit of claim 10, further comprising a blocking diode coupled in parallel with the first indicator, the blocking diode having a polarity opposite to a polarity of the first indicator.

15. The electrical circuit of claim 10, wherein the electrical circuit consists of a minimal number of discrete parts, including one dual light emitting diode (LED) with common anode, one dual NPN bipolar junction transistor (BJT), four resistors, and one diode.

16. An electrical circuit comprising:

a first illuminating indicator having a first color responsive to being energized;

a second illuminating indicator having a second, different color responsive to being energized, the second indicator and the first indicator having a common anode;

an indicator control means, a first lead of the indicator control means coupled to the common anode of the first and second indicators;

a first voltage dividing resistor coupled in series with the first indicator;

a second voltage dividing resistor coupled in series with the second indicator, and a cathode of the second indicator being coupled to the indicator control means via the second voltage dividing resistor; and an indicator control lead configured to carry a switching control signal to the indicator control means, the signal arranged to trigger the first or second indicator to energize, based on a value of the signal, such that responsive to the control lead being asserted the second indicator is energized and the first indicator is de-energized and responsive to the control lead being de-asserted the first indicator is energized and the second indicator is de-energized.

17. The electrical circuit of claim 16, wherein the first voltage dividing resistor is disposed between the first indicator and a control input of the indicator control means.

18. The electrical circuit of claim 16, wherein at least one of the first and second indicators comprises a light emitting diode (LED).

19. The electrical circuit of claim 16, wherein the indicator control means comprises a programmable logic device.

* * * * *